US009638428B1

(12) United States Patent
Hines, Jr.

(10) Patent No.: US 9,638,428 B1
(45) Date of Patent: May 2, 2017

(54) OVEN STRUCTURE

(75) Inventor: Robert S. Hines, Jr., Butler, TN (US)

(73) Assignee: Field Controls, LLC, Kinston, NC (US)

( * ) Notice: Subject to any disclaimer, the term of this patent is extended or adjusted under 35 U.S.C. 154(b) by 288 days.

(21) Appl. No.: 13/507,715

(22) Filed: Jul. 23, 2012

Related U.S. Application Data

(60) Provisional application No. 61/572,746, filed on Jul. 21, 2011.

(51) Int. Cl.
*F24C 15/32* (2006.01)
*A21B 1/00* (2006.01)
*F24C 15/20* (2006.01)

(52) U.S. Cl.
CPC ..... *F24C 15/2021* (2013.01)

(58) Field of Classification Search
USPC ..... 126/21 R, 293, 285 R, 289
See application file for complete search history.

(56) References Cited

U.S. PATENT DOCUMENTS 440,229 A * 11/1890 Keith ..... F23L 11/02 126/293
1,106,904 A * 8/1914 Walker ..... F23L 11/02 126/293
3,364,912 A * 1/1968 Dills et al. ..... 126/21 A
3,613,656 A * 10/1971 Henderson ..... 126/21 R
3,624,742 A * 11/1971 Hurko et al. ..... 126/39 D
3,627,290 A * 12/1971 Grieve ..... 432/48
4,186,876 A * 2/1980 Clark ..... F24F 11/04 137/468
4,202,259 A 5/1980 Johansson
4,250,917 A * 2/1981 Jespersen ..... A23B 4/031 137/563
4,265,213 A * 5/1981 Gorsuch ..... F24B 7/025 126/66
4,281,636 A 8/1981 Vegh et al.
4,336,748 A * 6/1982 Martin ..... A01K 1/0064 137/563
4,369,766 A * 1/1983 Coley ..... F24J 2/0433 126/572
4,404,956 A * 9/1983 Kutzner ..... F23N 1/045 126/293
4,444,175 A * 4/1984 Reynolds ..... 126/21 R
4,648,381 A * 3/1987 Ishii ..... A21B 3/04 126/20

(Continued)

FOREIGN PATENT DOCUMENTS

JP 55126742 9/1980

*Primary Examiner* — Avinash Savani
*Assistant Examiner* — George R Blum
(74) *Attorney, Agent, or Firm* — Brinks Gilson & Lione

(57) ABSTRACT

A cooking oven structure of conventional construction having a top vent provided thru an upper portion of the oven wall forming a cooking cavity, a bottom vent formed thru a lower portion of the wall, a chimney mounted on an exterior portion of the wall and exiting adjacent a top portion of the oven structure and communicating with the top and bottom cavity vents, and a damper mounted in the chimney and having a right angle configuration and pivotal about its apex to (a) a first position blocking gas flow both thru the top cavity vent and the chimney, (b) a second position blocking gas flow only thru the top cavity vent, and (c) a third position blocking gas flow only thru the chimney.

5 Claims, 7 Drawing Sheets

(56) References Cited

U.S. PATENT DOCUMENTS

| | | | | |
|---|---|---|---|---|
| 4,971,023 | A | 11/1990 | Martinez | |
| 5,394,860 | A * | 3/1995 | Borle | F24D 12/02 126/110 A |
| 5,680,810 | A | 10/1997 | Sham | |
| 6,041,770 | A * | 3/2000 | Erickson | F23N 3/047 112/193 |
| 6,202,637 | B1 | 3/2001 | Roberts | |
| 6,860,261 | B2 * | 3/2005 | Hines, Jr. | A21B 1/08 126/20 |
| 2004/0065311 | A1 * | 4/2004 | Hines, Jr. | A21B 1/08 126/20 |
| 2008/0014859 | A1 * | 1/2008 | Edmisten | F24F 13/084 454/290 |
| 2013/0025582 | A1 * | 1/2013 | Cadima et al. | 126/289 |
| 2013/0152913 | A1 * | 6/2013 | Raghavan | A21B 3/04 126/20 |
| 2013/0237140 | A1 * | 9/2013 | Contreras | F24F 11/0076 454/239 |
| 2013/0255660 | A1 * | 10/2013 | Han et al. | 126/273 R |
| 2014/0041828 | A1 * | 2/2014 | Yoshida | B60H 1/00642 165/41 |

* cited by examiner

OVEN STRUCTURE

This application claims priority under 35 U.S.C. 119(e)(1) based on Applicants Provisional U.S. Patent Application Ser. No. 61/572,746 filed Jul. 21, 2011 of same title.

BACKGROUND

Field

This invention is directed to a gas fired cooking oven structure which is specially constructed to conserve heat energy, particularly during a burner off mode.

Conventional gas baking ovens generally use a venting strategy illustrated in FIGS. 1 and 2 herein for bake and broil respectively. Most OEM ovens vent products of combustion and cooking near the back oven wall and at the top of the oven after traveling from the burner through the oven cooking cavity and then to the vent. The purpose of the vent is to expel the products of combustion and secondarily to vent the gases created by baking, cooking and broiling. The oven temperatures are generally modulated by an off/on burner cycle. During the burner "on" cycle, air flows from the open bottom of the oven, through the oven cavity along with the combustion products, to the top of the oven. The hot air being lighter, it then egresses through the vent at the top of the cavity. This vent is sized to allow enough air flow to sustain a stoichiometric reaction. During the burner "off" cycle, air continues to flow due to the diminished density of the hot air rising and exiting through the vent. This continuous flow during the burner "off" cycle produces substantial heat loss and wasted energy. Venting for the broiler works in a similar fashion with comparable air flow.

SUMMARY OF THE INVENTION

Energy may be conserved by modifying the OEM conventional venting by following and combining two strategies:

1. The top vent is supplemented by a lower vent and connecting duct work that essentially functions as a chimney FIGS. 3, 4, 5 & 6. In the bake mode with the burner in an "on" cycle, air and products of combustion rise to the top. If the top vent is occluded during this portion of the cycle, the hot air and gases must circulate (FIG. 3) and return to the bottom vent, then exit the oven cavity through the bottom vent. This is facilitated by the elongated connecting duct which now acts as a chimney drawing the air from the cavity but only after it is circulated from the bottom of the oven cavity to the top then back down and exits the bottom vent. Negative pressure created by hot air in the connecting and exit vent draw the air from the oven cavity. This small but important increase in circulation time has been proven to save an average of 19% fuel usage on three prototypes installed in different brands of residential gas ovens currently on the market.

2. In addition, inserting a damper mechanism at the top vent junction and connecting duct that has the ability to close egress from the top and open the egress from the bottom vent during the burner "on" cycle (FIG. 3) and is able to close both the top and bottom vents during the burner "off" cycle, allowing for increased circulation time and enhance energy transfer during the "on" cycle and trapping the hot air during the "off" cycle. The trapping of hot air adds 15-17% more fuel efficiency for a total 35%.

The question then arises, "Why retain the upper vent?" Prototyping has proven on some OEM models that the broiler noxious gases are retained for greater than nine minutes before the burner "cleans up". It cleans up only after the duct system reaches sufficient temperature to sustain the "chimney effects". In one modified OEM the noxious gases did not "clean up" and the air free carbon monoxide remained at unacceptable levels. Retaining the upper vent during broiler function allows a quick clean up on an added margin of safety. It then remains how to solve the problem of achieving the various open/close damper positions. This is accomplished by a unique L-shaped damper (see all Figs.). By positioning this L-shaped damper as shown in the sequential Figures the damper accomplishes this by rotating to three positions illustrated in FIGS. 3, 4, 5, & 6. In summary, in the bake mode, burner "on" cycle (FIG. 3) the bottom vent is open and the top is closed. In the bake mode burner "off" cycle the bottom and top vents are closed (FIG. 4). In the broiler mode, in both "on & off" cycles the top vent is open and bottom closed. This is also the default position for safety sake.

Preferred embodiment for the damper movement is a stepper motor that will rotate 270 degrees and works bi-directionally. An electronic controller board is necessary for the motor function. Sensing for each cycle is easily obtained from an electrical input from current to either the ignition mechanism (spark or flat surface igniter) or current to the electric gas valve.

U.S. Pat. No. 6,860,261 B2 (Hines) is a current patent covering the bottom venting strategy. Expired U.S. Pat. No. 4,648,381 Toshio relates to damping mechanism during the "off/on" cycle. The disclosures of both of these patents are hereby incorporated herein by reference in their entireties.

BRIEF DESCRIPTION OF DRAWINGS

The invention will be understood further from the drawings herein wherein:

FIG. 5 is a view as in FIG. 3 with the broil unit on; and

Figure 1:
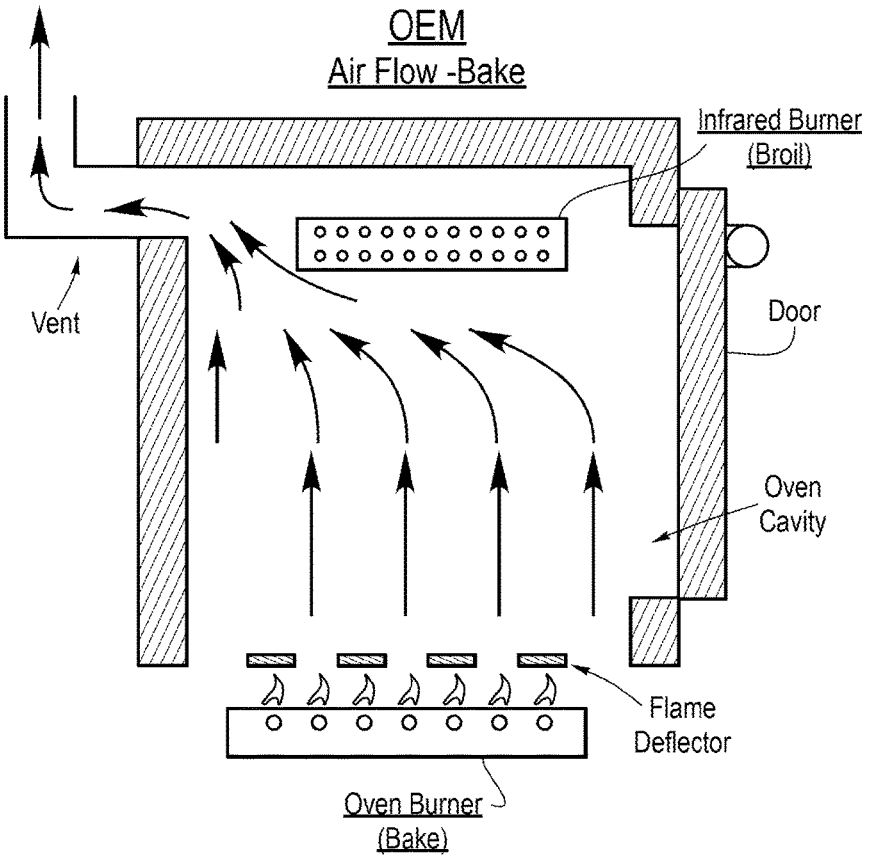
Fig. 1 Prior Art
FIG. 1 is a cross-sectional view of a prior art venting system.
Figure 2:
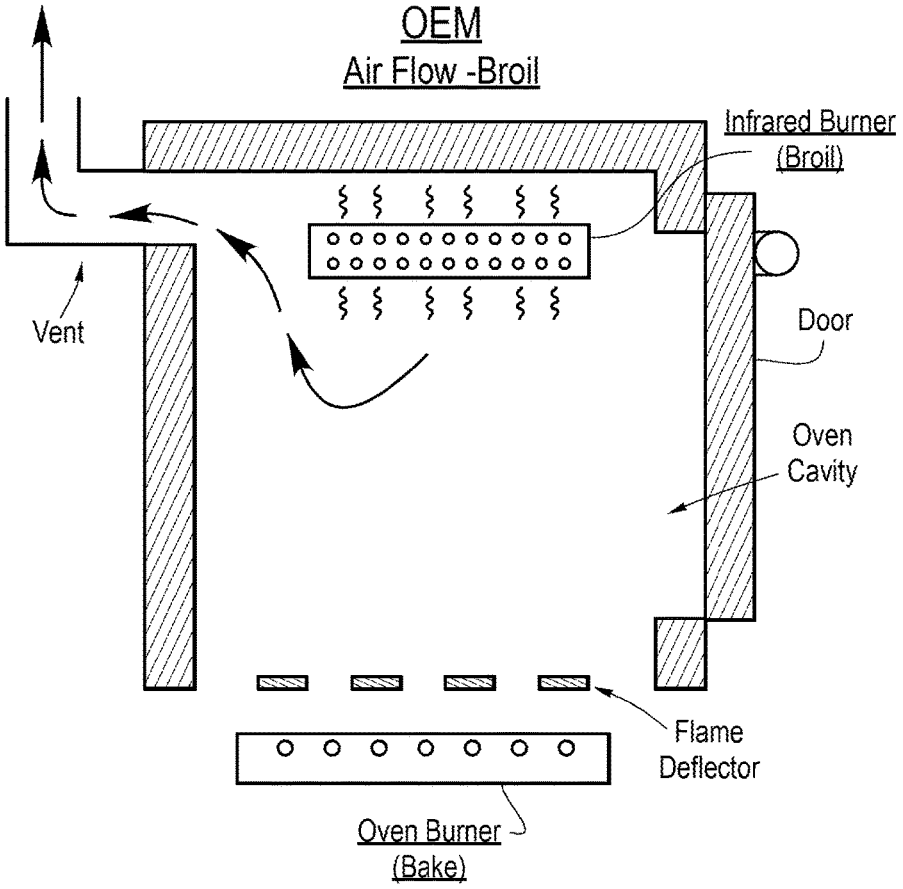
Fig. 2 Prior Art
FIG. 2 is a cross-sectional view of a prior art venting system.
Figure 3:
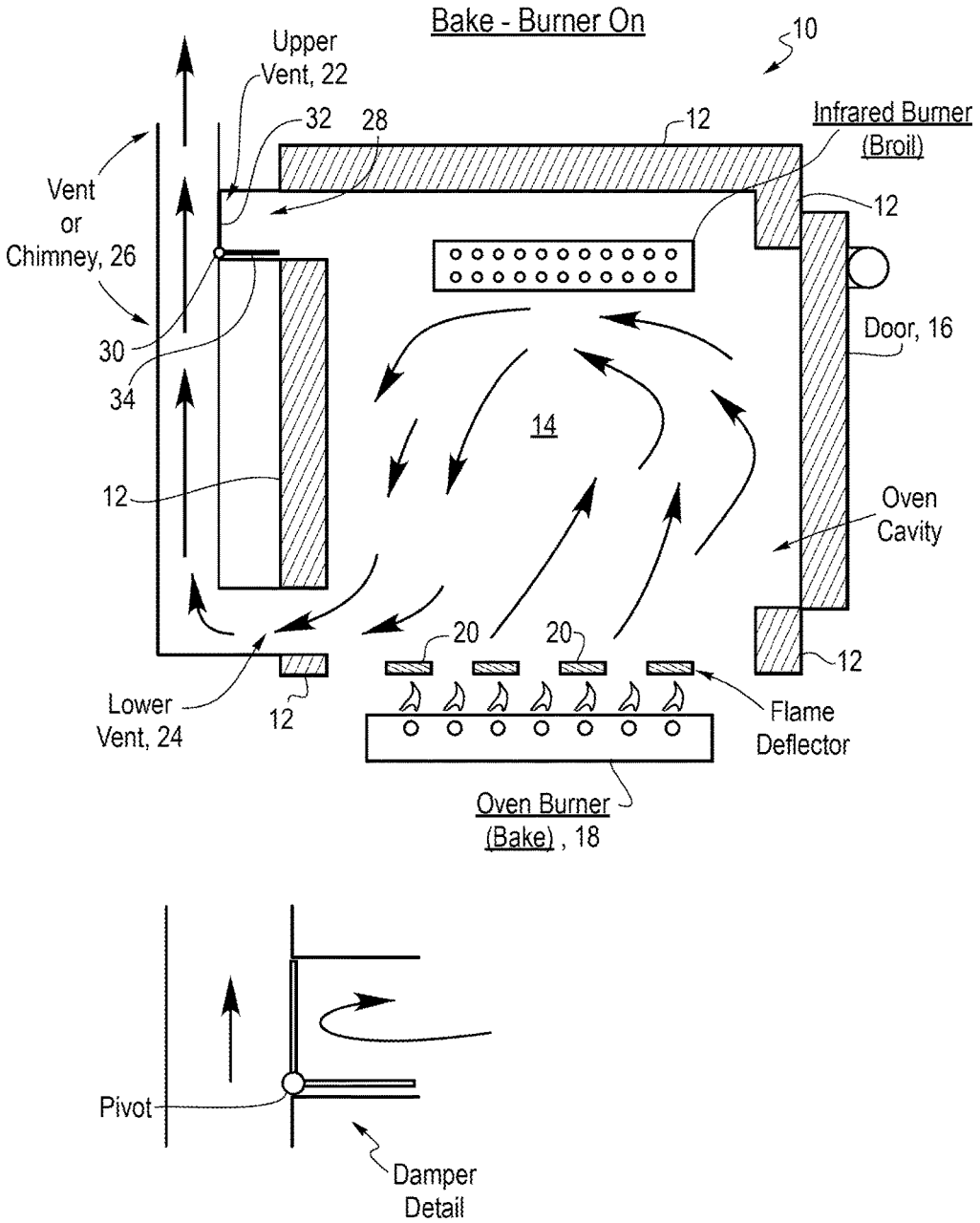
FIG. 3 is a cross-sectional view of a gas fired cooking oven employing the present energy saving damper in operative position.
Figure 4:
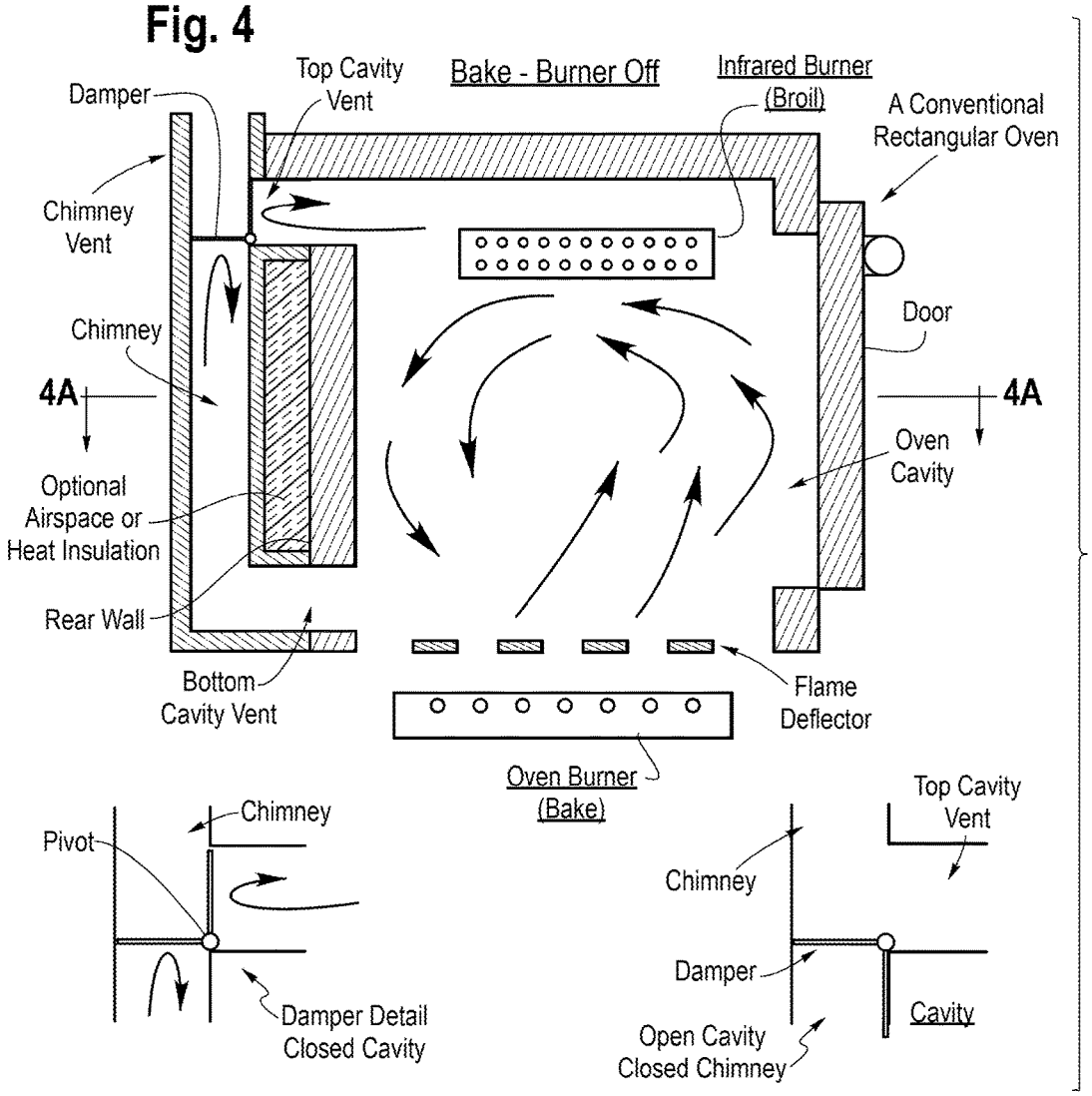
FIG. 4 is a view as in FIG. 3 with the burner in off mode.
Figure 4A:
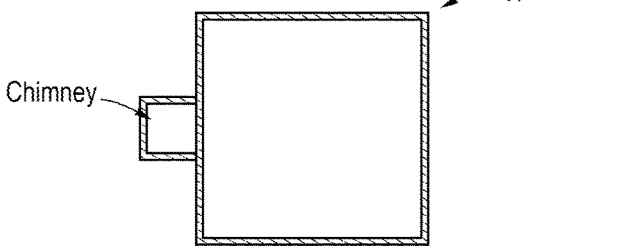
Figure 5:
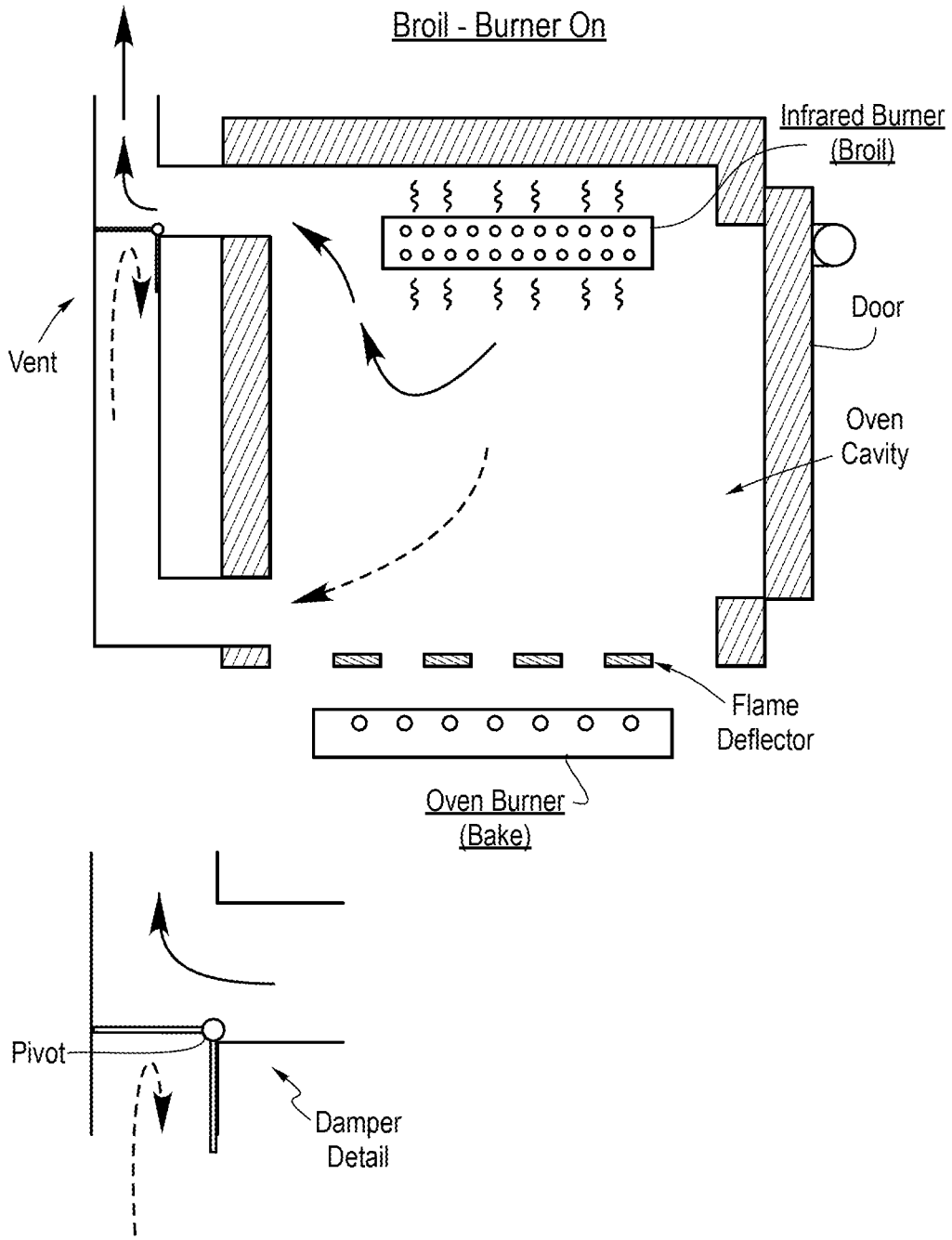
Figure 6:
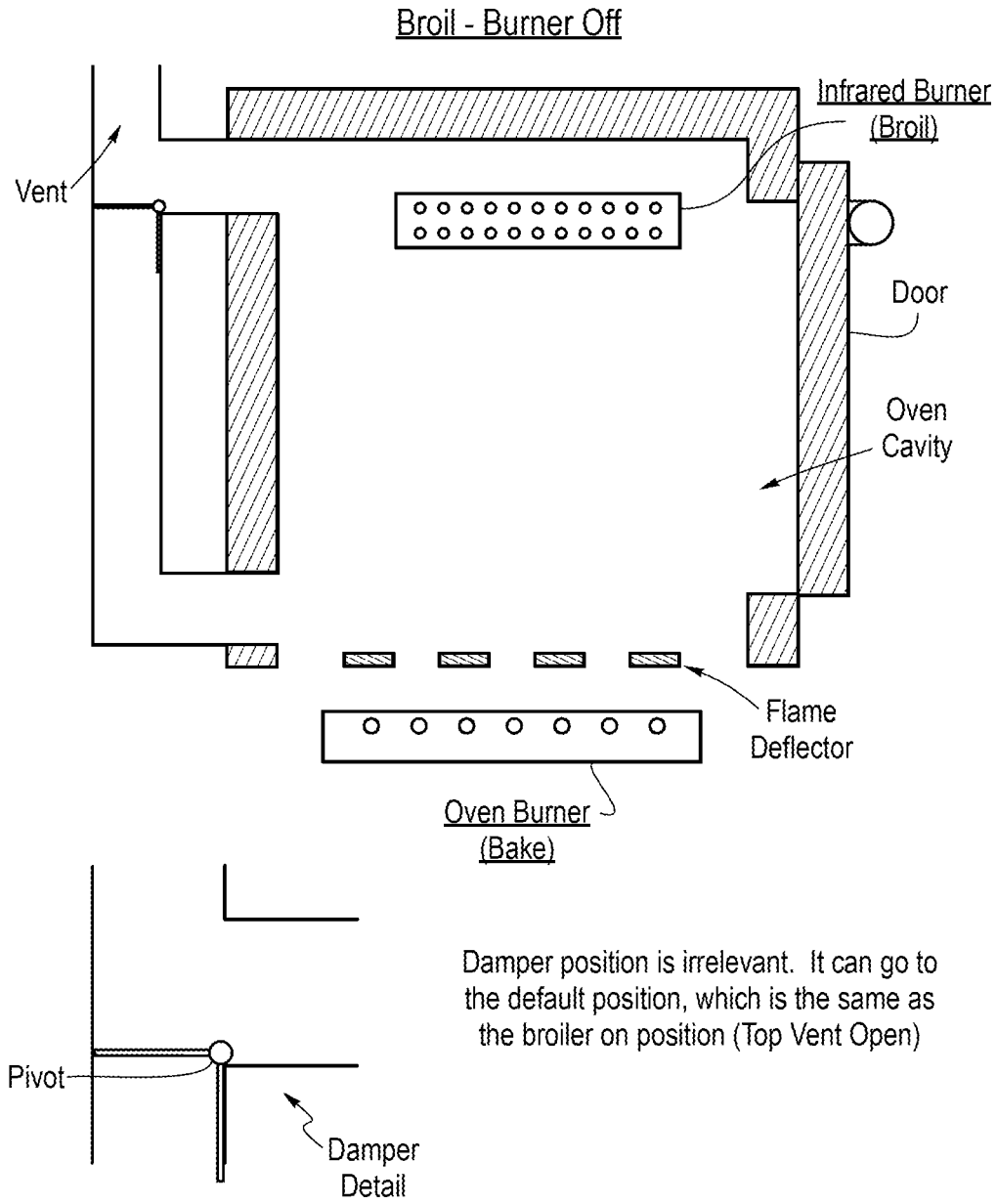
FIG. 6 is a view as in FIG. 3 with broil unit and gas burner off.
Figure 7:
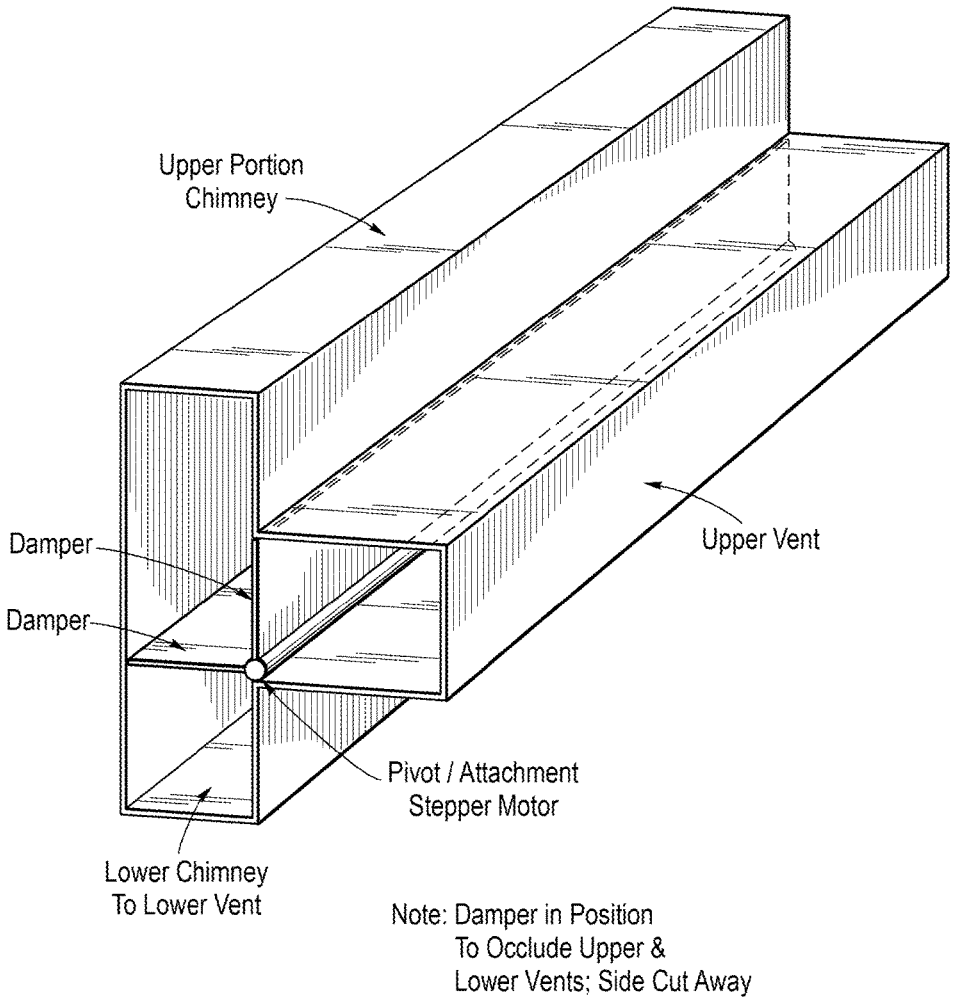

Referring to the drawings and with particular reference to the claims herein, the present gas fired cooking oven comprise a shell generally designated 10 formed by wall means 12 providing a cooking cavity 14, the wall means including side walls, a top wall and a floor, an access door 16 provided in a wall, a gas (flammable) burner 18 positioned under the floor, a grating 20 in the floor for allowing hot combustion gases and heated air to flow upwardly into the cooking cavity. A top cavity vent 22 is provided thru an upper portion of the wall means, a bottom cavity vent 24 formed thru a lower portion of the wall means, and a chimney 26 is provided by the wall means on an exterior portion of the wall means forming the cavity and exiting adjacent a top portion of the oven structure and communicating with the top and bottom cavity vents. A right angle damper means 28 having apex 30 as its pivot is mounted in the chimney and having (a) a first position blocking gas flow both thru the top cavity vent and the chimney, (b) a second position blocking gas flow only thru the top cavity vent, and (c) a third position blocking gas flow only thru the chimney. The damper means has two damper sections 32, 34 oriented at a right angle to each other and pivotally mounted at the angle apex to the wall means at the juncture of the top cavity vent and the chimney.

The invention has been described in detail with particular reference to preferred embodiments thereof, but it will be understood that variations and modifications will be effected within the spirit and scope of the invention.

I claim:

1. An oven structure, comprising:

a cooking cavity comprising side walls, a top wall and a floor;

a top cavity vent provided at an upper portion of the cooking cavity;

a bottom cavity vent provided at a lower portion of the cooking cavity;

a chimney provided exterior to the cooking cavity, wherein the chimney is adapted to communicate with the top cavity vent and the bottom cavity vent; and a damper pivotably mounted only at the top cavity vent in an exhaust flow path, comprising a first damper section and a second damper section orthogonally connected at their edges at a pivot point, wherein the damper is operable to effect gas flow in:

(a) a first position blocking gas flow both through the top cavity vent and the chimney, wherein the first damper section blocks gas flow through the chimney and wherein the second damper section blocks gas flow through the top cavity vent;

(b) a second position blocking gas flow only through the top cavity vent, wherein the first damper section blocks gas flow through the top cavity vent;

and (c) a third position blocking gas flow only through the chimney, wherein the second damper section blocks gas flow through the chimney.

2. The oven structure of claim 1, further comprising an access door provided in one of the walls of the cooking cavity.

3. The oven structure of claim 1, further comprising a gas burner positioned under the floor, and a grating in the floor for allowing hot combustion gases and heated air to flow upwardly into the cooking cavity.

4. The oven structure of claim 1, wherein the damper is an L-shaped damper.

5. The oven structure of claim 2, wherein the first damper section and the second damper section are joined at an apex.

* * * * *